US008965247B2

(12) United States Patent
Katayama

(10) Patent No.: US 8,965,247 B2
(45) Date of Patent: Feb. 24, 2015

(54) IMAGE FORMATION APPARATUS AND FIXATION DEVICE

(71) Applicant: Oki Data Corporation, Tokyo (JP)

(72) Inventor: Kazuoki Katayama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/904,079

(22) Filed: May 29, 2013

(65) Prior Publication Data

US 2013/0322895 A1 Dec. 5, 2013

(30) Foreign Application Priority Data

May 31, 2012 (JP) ..... 2012-124592

(51) Int. Cl.
*G03G 15/16* (2006.01)
*G03G 21/10* (2006.01)
*G03G 15/20* (2006.01)

(52) U.S. Cl.
CPC ..... *G03G 21/10* (2013.01); *G03G 15/2017* (2013.01)
USPC ..... 399/122; 399/326

(58) Field of Classification Search
CPC ..... G03G 15/20–15/2096
USPC ..... 399/122
See application file for complete search history.

(56) References Cited

U.S. PATENT DOCUMENTS

| | | | | |
|---|---|---|---|---|
| 5,722,012 | A * | 2/1998 | Saitoh | 399/99 |
| 7,720,422 | B2 * | 5/2010 | Son et al. | 399/327 |
| 2005/0214024 | A1 * | 9/2005 | Yamaguchi et al. | 399/111 |

FOREIGN PATENT DOCUMENTS

| | | | |
|---|---|---|---|
| JP | S57-136956 | U | 8/1982 |
| JP | S57-138872 | A | 8/1982 |
| JP | S57136672 | A * | 8/1982 |
| JP | H04-219775 | A | 8/1992 |
| JP | H09-090730 | A | 4/1997 |
| JP | H09-090803 | A | 4/1997 |
| JP | 2010-085799 | A | 4/2010 |

OTHER PUBLICATIONS

English Abstract of JP 557136672A.*

* cited by examiner

*Primary Examiner* — Clayton E Laballe
*Assistant Examiner* — Ruifeng Pu
(74) *Attorney, Agent, or Firm* — Marvin A. Motsenbocker; Mots Law, PLLC

(57) ABSTRACT

A fixation unit includes a fixation member and a housing containing therein the fixation member. The fixation member is configured to thermally fix a developer image onto a medium being conveyed from an image formation unit to the fixation unit along a medium conveyance path, wherein the developer image is formed at the image formation unit and transferred onto the medium by the image formation unit. The developer attachment member is replaceably provided to the fixation unit and configured to attach thereto a part of the developer that is scattered in the neighborhood of the conveyance path.

22 Claims, 9 Drawing Sheets

IMAGE FORMATION APPARATUS AND FIXATION DEVICE

CROSS REFERENCE TO RELATED APPLICATIONS

This application claims priority based on 35 USC 119 from prior Japanese Patent Application No. 2012-124592 filed on May 31, 2012, entitled "IMAGE FORMATION APPARATUS AND FIXATION DEVICE", the entire contents of which are incorporated herein by reference.

BACKGROUND OF THE INVENTION

1. Field of the Invention

This disclosure relates to an image formation apparatus and a fixation device, which are configured to thermally fix a developer image transferred to a medium.

2. Description of Related Art

When unfixed powder toner (a developer) is scattered on a recording sheet as a medium and the scattered toner is attached to and deposited on a conveyance path (a conveyance route) where the recording sheet passes through, the toner causes a stain on the recording sheet or an image defect. Conventionally, such a stain on the recording sheet or an image defect is prevented by flicking off the toner attached onto the conveyance route (such as a pre-fixation guide) by using an electrostatic force (see Patent Document 1: Japanese Patent Application Publication No. 2010-085799).

SUMMARY OF THE INVENTION

However, in the conventional art, the toner is attached to an upper portion (such as a position above an entrance where the recording sheet is inserted) of a housing which contains a fixation member, and the toner thus deposited may grow into a lump of the toner (the developer) and eventually fall onto a recording sheet in the conveyance process.

An object of an embodiment of the invention is to enable elimination of a developer attached to a housing which contains a fixation member.

An aspect of the invention provides an image formation apparatus that includes: an image formation unit configured to form a developer image and to transfer the developer image to a medium; a fixation unit including a fixation member configured to thermally fix the developer image onto the medium being conveyed from the image formation unit through the fixation unit along a medium conveyance path, and a housing containing therein the fixation member; and a developer attachment member replaceably provided to the fixation unit and configured to cause the developer that is scattered in the neighborhood of the conveyance path to become attached to the developer attachment member.

According to this aspect of the invention, it is possible to eliminate developer from becoming attached to a housing containing a fixation member.

BRIEF DESCRIPTION OF THE DRAWINGS

FIGS. 3A and 3B are views for explaining a configuration of a fixation unit according to the first embodiment, in which FIG. 3A is a vertical sectional view of the fixation unit viewed in the direction of arrows A, A (in FIG. 3B) and FIG. 3B is a front view of the fixation unit.

FIGS. 5A and 5B are views for explaining a configuration of a fixation unit according to a second embodiment, in which FIG. 5A is a vertical sectional view of the fixation unit viewed in the direction of arrows B, B and FIG. 5B is a front view of the fixation unit.

FIGS. 7A and 7B are views for explaining a configuration of the rotor according to the second embodiment, in which FIG. 7A is a first enlarged perspective view of a substantial part of the rotor and FIG. 7B is a second enlarged perspective view of a substantial part of the rotor.

DETAILED DESCRIPTION OF EMBODIMENTS

Figure 1:
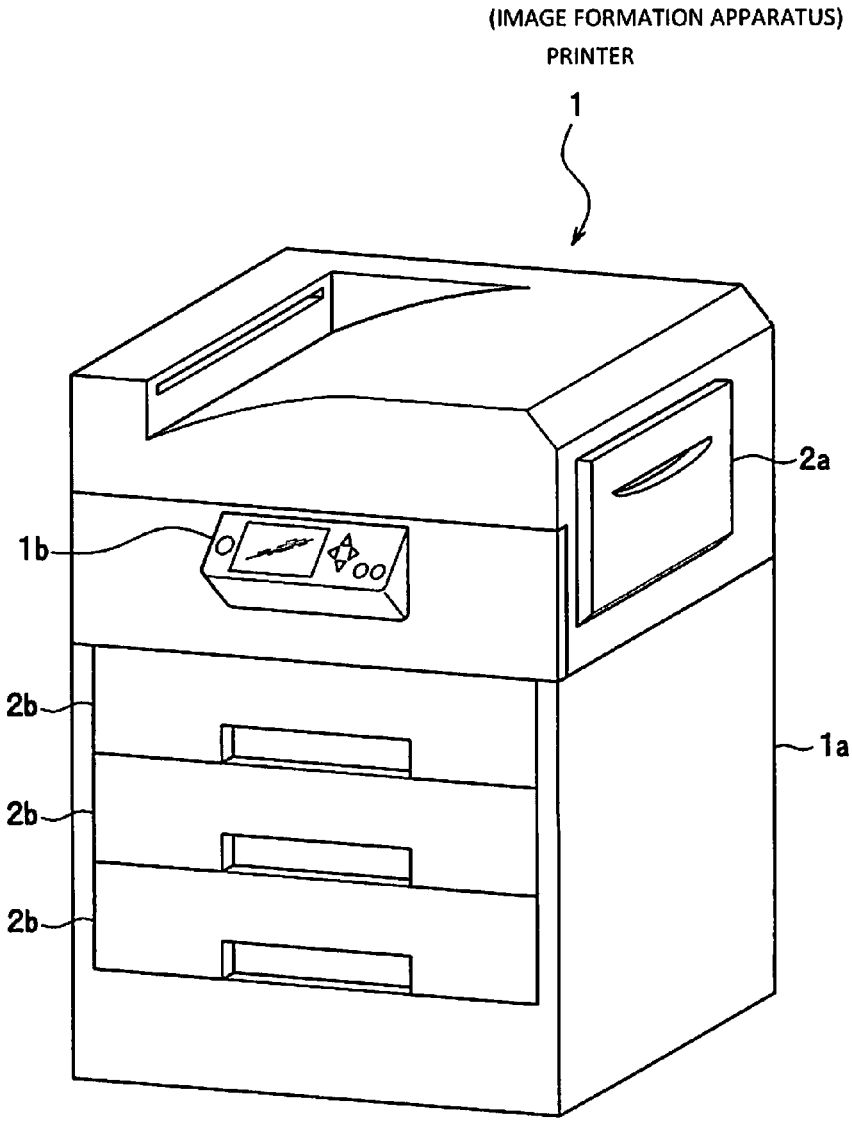
FIG. 1 is an external perspective view of a printer according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of the invention are described below in detail with reference to the drawings. It is to be noted that the drawings are merely schematic illustrations to enable a sufficient understanding of the invention. The invention is therefore not limited to only the illustrated examples. In the drawings referred to, dimensions of the components constituting the invention are exaggerated in order to clarify the descriptions. It is to be also noted that common constituents and similar constituents in the drawings are denoted by the same reference numerals and overlapping descriptions thereof are omitted.

First Embodiment

Figure 2:
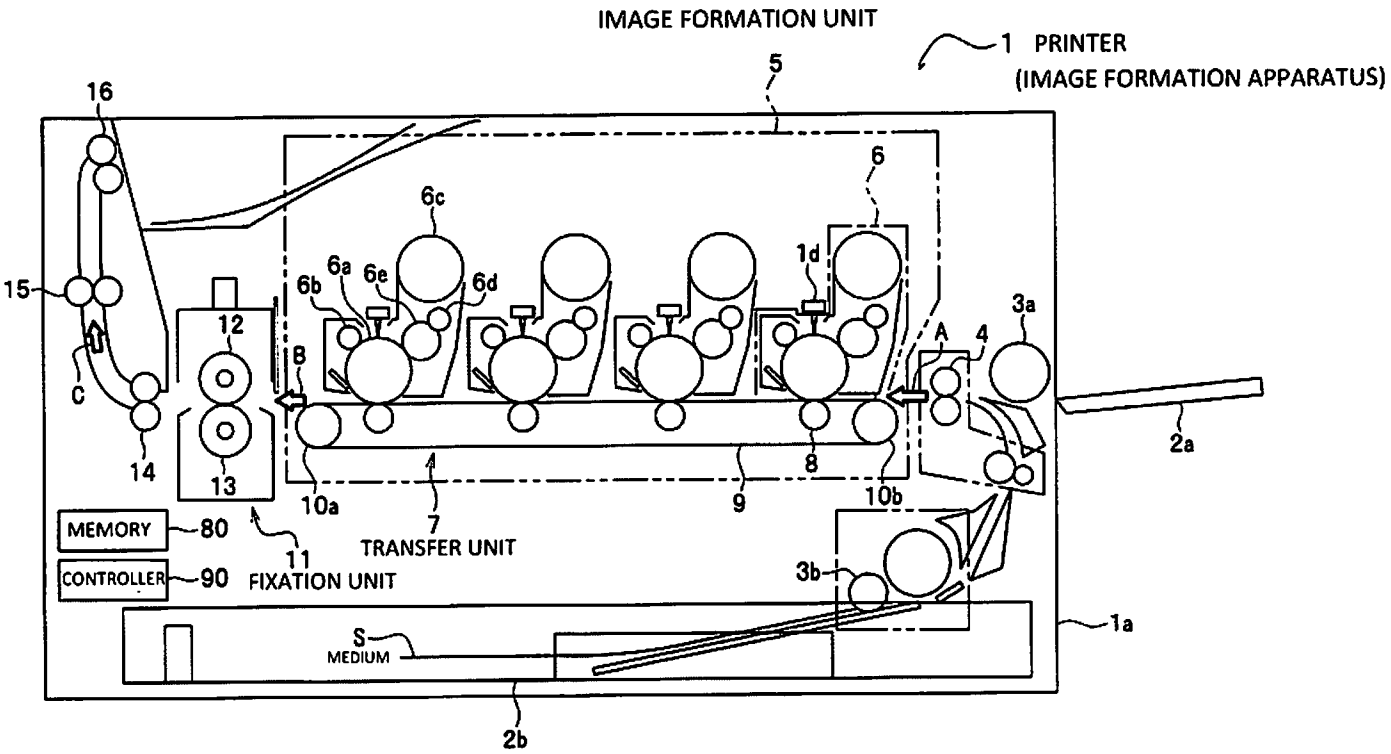
FIG. 2 is a schematic cross-sectional view of the printer according to the first embodiment.

Configuration of an Image Formation Apparatus According to the First Embodiment A configuration of printer 1 as an image formation apparatus is described with reference to FIG. 1 and FIG. 2. FIG. 1 is an external perspective view of printer 1 as an image formation apparatus according to a first embodiment. FIG. 2 is a schematic cross-sectional view of printer 1 as the image formation apparatus according to the first embodiment.

Printer 1 as the image formation apparatus includes: operation panel 1*b* provided on a front surface of printer body 1*a* and including a liquid crystal display; manual feed tray 2*a* provided on a side surface of printer body 1*a*, made openable and closable while using its lower side as a rotation axis, and allowing printing media S to be stacked on its upper part in an opened state; paper feed tray 2*b* provided at a lower part of printer 1 and capable of containing printing media S inside; paper feed roller 3*a* configured to feed media S from manual feed tray 2*a*; paper feed roller 3*b* configured to feed media S from paper feed tray 2*b*; conveyance rollers 4 configured to convey media S, which pass through paper feed rollers 3*a* and 3*b*, inside printer body 1*a* in a downstream direction (in a direction of arrow A); image formation unit 5 including development units 6 and transfer unit 7 and configured to form toner images on media S passing through conveyance rollers 4; fixation unit 11 configured to fix the toner images, which are formed on media S by image formation unit 5, onto media S; conveyance rollers 14 arranged in the vicinity of fixation unit 11 and configured to discharge media S from fixation unit 11; conveyance rollers 15 configured to convey media S, which pass through conveyance rollers 14, inside printer body 1*a* in a downstream direction (in a direction of arrow C); discharge rollers 16 configured to discharge media S, which pass through conveyance rollers 15, outside printer body 1*a*; memory 80 or a storage unit; and controller 90. Next, configurations of image formation unit 5, fixation unit 11, memory 80, and controller 90 are described in detail.

<Image Formation Unit>

Image formation unit 5 includes: development units 6 arranged in a row in a direction of conveyance and respectively configured to form toner images (developer images) in colors of cyan (C), yellow (Y), magenta (M), and white (W); optical heads 1*d* configured to form electrostatic latent images serving as bases of the toner images in the respective colors on photoconductor drums 6*a*, and transfer unit 7 arranged below development units 6 and configured to transfer the toner images formed by development units 6 onto medium S. Configurations of the components are next described in detail.

(Development Units, Optical Heads)

Each development unit 6 includes photoconductor drum 6*a*, charge roller 6*b*, toner cartridge 6*c*, supply roller 6*d*, and development roller 6*e*. Photoconductor drum 6*a* is rotatable at a predetermined rotational speed. A photoconductive layer for accumulating charges is formed on a surface of photoconductor drum 6*a*. The charges on the surface can be removed by light exposure using optical head 1*d*. Charge roller 6*b* is in contact with the surface of photoconductor drum 6*a* at a steady pressure and charges photoconductor drum 6*a* by applying a predetermined voltage. Optical head 1*d* is arranged above photoconductor drum 6*a* and is configured to form the electrostatic latent image on the surface of photoconductor drum 6*a* by removing the charges on the surface of photoconductor drum 6*a* by means of light exposure.

Each toner cartridge 6*c* contains a developer (toner) in the corresponding color. Supply roller 6*d* is in contact with development roller 6*e* at a given pressure and supplies the toner, which is supplied from toner cartridge 6*c*, to development roller 6*e*. A predetermined bias voltage is applied to development roller 6*e*, so that development roller 6*e* moves the toner supplied via supply roller 6*d* onto the photoconductor drum 3*a* to form an electrostatic latent image by use of a potential difference (an electric field) between development roller 6*e* and the electrostatic latent image formed on photoconductor drum 6*a*. Thus, the electrostatic latent image formed on photoconductor drum 6*a* is developed and a toner image is formed on photoconductor drum 6*a*.

(Transfer Unit)

Transfer unit 7 includes transfer rollers 8 arranged below respective development units 6, transfer belt 9, drive roller 10*a*, and driven roller 10*b*. A bias voltage of a reverse polarity to the toner image formed on photoconductor drum 6*a* is applied to transfer roller 8. Transfer belt 9 is made of a conductive material and the bias voltage on transfer roller 8 is transferred thereto. Thus, the toner image formed on photoconductor drum 6*a* is transferred by a Coulomb force onto medium S being conveyed on transfer belt 9. Drive roller 10*a* suspends one end of transfer belt 9 and conveys medium S on transfer belt 9 in a direction of arrow B by means of rotation. Driven roller 10*b* suspends another end of transfer belt 9 and is driven and rotated by drive roller 10*a* with the assistance of transfer belt 9.

<Fixation Unit>

Figure 3B:
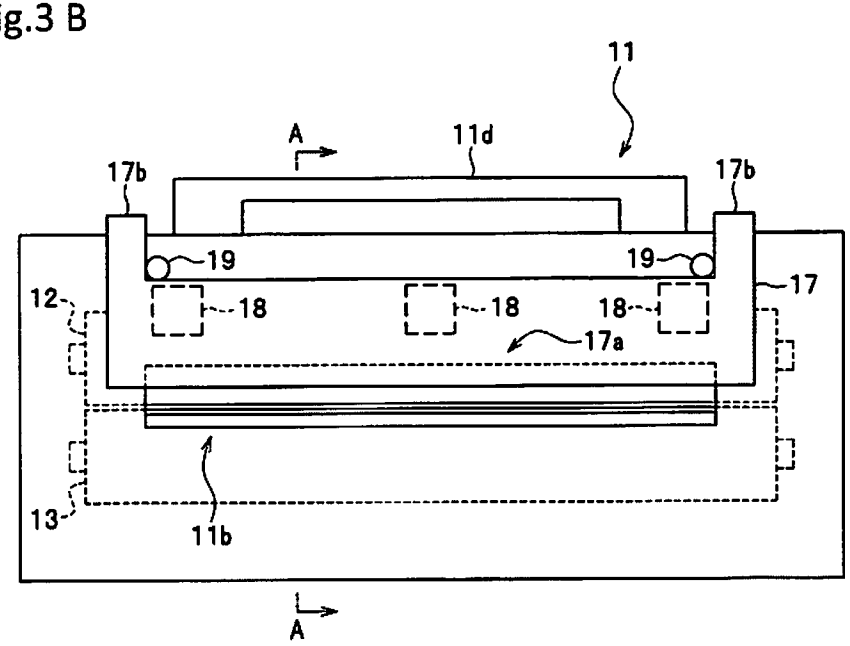
Figure 3A:
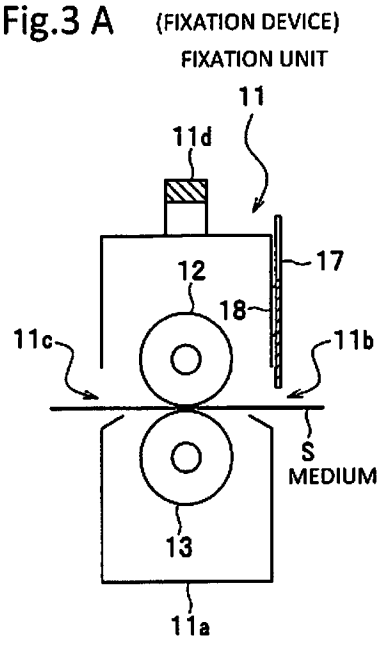
Figure 4:
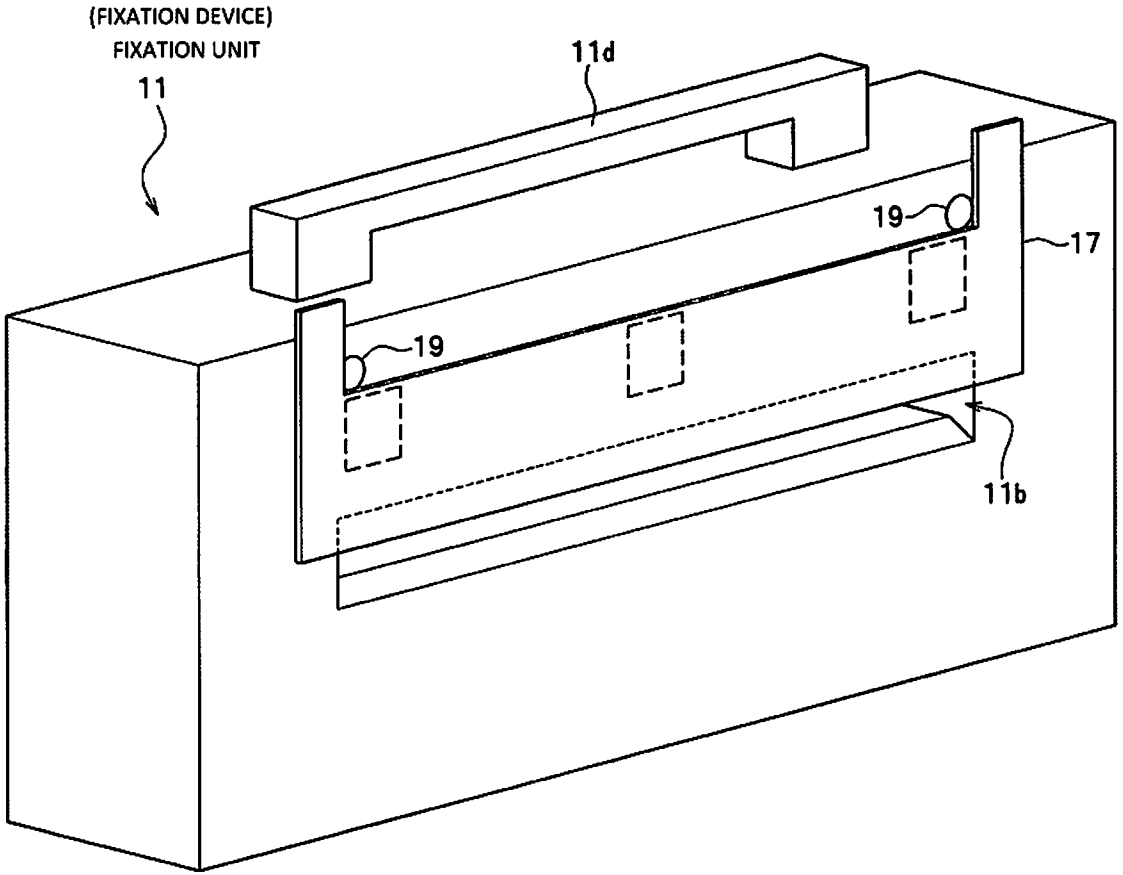
FIG. 4 is an external perspective view of the fixation unit according to the first embodiment.

A configuration of fixation unit 11 according to the first embodiment is described with reference to FIG. 3A to FIG. 4. FIG. 3A is a vertical sectional view of fixation unit 11 according to the first embodiment viewed in the direction of arrows A, A, and FIG. 3B is a front view of fixation unit 11 according to the first embodiment. FIG. 4 is an external perspective view of fixation unit 11 according to the first embodiment.

Fixation unit 11 includes: heating roller 12 heated by a fixation heat generator (such as a halogen lamp) placed inside and configured to thermally fix the toner image on medium S transferred by transfer unit 7; pressure roller 13 arranged in a position opposed to heating roller 12 while interposing medium S in between, and configured to be pressed against heating roller 12; housing 11*a* containing heating roller 12 and pressure roller 13 and provided with insertion slot 11*b* used to insert medium S; discharge slot 11*c* formed on the opposite surface from the surface where insertion slot 11*b* is formed and used to discharge medium S; and grip 11*d* in a horseshoe shape (a U-shape) to be gripped by a user of printer 1 (see FIG. 1) when fixation unit 11 is taken out of printer 1; and toner attachment sheet 17 designed to have scattered toner become attached thereto, with the toner attachment sheet made replaceable by being attached to a position of housing 11*a* above insertion slot 11*b* using square adhesive sheets 18 (three in FIG. 3B). In the following, a surface out of six surfaces of housing 11*a* which is opposed to development unit 6 (which can also be said as a surface where insertion slot 11*b* of fixation unit 11 is formed in the embodiment) is referred to as a front surface of fixation unit 11. Meanwhile, heating roller 12 and pressure roller 13 may be collectively referred to as a fixation member as appropriate. Now, the toner attachment sheet is described below in detail.

(Toner Attachment Sheet)

Toner attachment sheet 17 as a developer attachment member includes attachment portion 17*a* located on a surface and configured to attach a splash of part of the toner forming the toner images before the splash part of the toner becomes fixed to medium S and becomes attached onto a conveyance route (such toner may be collectively referred to as "scattered toner" as appropriate). Attachment portion 17*a* is made of a material (such as heat-resistant PVC (polyvinyl chloride)) which has an adequate heat resistance for avoiding thermal deformation in the case of a rise in temperature of fixation unit 11, and facilitates attachment of the toner at the same time. Here, attachment portion 17*a* may be provided not only to the surface of toner attachment sheet 17 but also to the entirety of toner attachment sheet 17.

In addition, toner attachment sheet 17 has extension portions 17*b* extending upward, and are located on two ends of toner attachment sheet 17. Extension portions 17*b* protrude above fixation unit 11. For this reason, the user of printer 1 (see FIG. 1) can replace toner attachment sheet 17 with a new one by clutching extension portions 17*b* without touching fixation unit 11. Thus, the user is in no danger of a burn even if fixation unit 11 is hot. Here, it is preferable to form mark 19 on the front surface of fixation unit 11 by means of a stamp or the like which is used for positioning upon replacement of toner attachment sheet 17. This allows the user of printer 1 (see FIG. 1) to replace toner attachment sheet 17 easily.

(Memory)

Memory 80 is made of a storage medium such as a RAM (random access memory), a ROM (read only memory), a HDD (hard disk drive) or a flash memory. Memory 80 stores print image data transmitted from a not-illustrated high-order apparatus (such as a PC) connected to printer 1, and information necessary for operating printer 1. In addition, memory 80 stores replacement time information concerning the time for replacement of toner attachment sheet 17. In the embodiment, the time for replacement is linked to the number of sheets printed by image formation unit 5 and is defined as an occasion when the number of prints exceeds a predetermined number (when the number exceeds 25,000 sheets, for example).

(Controller)

Controller 90 is implemented by program execution processing with a CPU (central processing unit), by a dedicated circuit, and the like. Controller 90 controls the devices (such as image formation unit 5) in printer 1 and forms a print image on medium S based on the print image data transmitted from the not-illustrated high-order apparatus connected to printer 1. In addition, controller 90 counts the number of times image formation unit 5 forms the print image, and outputs a replacement instruction for toner attachment sheet 17 to operation panel 1*b* as an output unit when the counted number exceeds the replacement time information stored in memory 80. Here, the replacement instruction is assumed to be an image indicating "please replace with a new toner attachment sheet", for example. In the following, controller 90 may be referred to as a "replacement instruction unit" as appropriate. This is the end of the explanation of printer 1 as the image formation apparatus according to the first embodiment.

Operations of the Image Formation Apparatus According to the First Embodiment <Image Formation Operation>

An image formation operation by printer 1 as the image formation apparatus is described with reference to FIG. 2 (and FIGS. 3A and 3B as appropriate). Upon receipt of a print command from the not-illustrated high-order apparatus (such as the PC) connected to printer 1, controller 90 of printer 1 drives paper feed roller 3*a* in contact with medium S stacked on manual feed tray 2*a* or drives paper feed roller 3*b* in contact with medium S contained in paper feed tray 2*b*. Thus, medium S is conveyed in the direction of arrow A in FIG. 1 via conveyance rollers 4, and arrives at image formation unit 5.

Next, controller 90 drives drive roller 10*a* to convey medium S in the direction of the arrow B in FIG. 1. In this process, controller 90 controls optical heads 1*d*, development units 6, transfer unit 7 and the like to form the toner images on medium S based on the print image data received together with the print command. Subsequently, controller 90 drives fixation unit 11 to fix the toner images onto the surface of medium S by using the heat and pressure applied from heating roller 12 and pressure roller 13. Then, controller 90 drives conveyance rollers 14, conveyance rollers 15, and discharge rollers 16 to discharge medium S to the outside of printer body 1*a*. This is the end of the explanation of the image formation operation of printer 1 as the image formation apparatus according to the first embodiment.

<Operation Concerning Replacement of Toner Attachment Sheet>

Next, an operation concerning the replacement of toner attachment sheet 17 in printer 1 as the image formation apparatus is described with reference to FIG. 3A to FIG. 4. During the image formation operation described above, fixation unit 11 continuously radiates the heat since heating roller 12 includes a heat source (such as the halogen lamp). For this reason, upward air convection is constantly generated between fixation unit 11 and developer unit 6 inside printer 1. Meanwhile, part of the toner forming the toner images on the surface of medium S is scattered from medium S due to vibrations generated when medium S is inserted into fixation unit 11. Then, the scattered toner gets on the upward air convection and thereby moves up to toner attachment sheet 17 arranged on an anterior surface of fixation unit 11. Then, the toner is melted by the heat and fixed to attachment portion 17*a* of toner attachment sheet 17.

In the meantime, controller (replacement instruction unit) 90 counts the number of times image formation unit 5 forms the toner image, and outputs the replacement instruction (the image indicating "please replace with a new toner attachment sheet") for toner attachment sheet 17 to operation panel 1*b* as the output unit when the counted number exceeds the replacement time information stored in memory 80. Then, the user who sees the display of the replacement instruction for toner attachment sheet 17 takes fixation unit 11 out of printer 1 by grasping grip 11*d* of fixation unit 11 and replaces toner attachment sheet 17 with a new one. This is the end of the explanation of the operation concerning the replacement of toner attachment sheet 17 in printer 1 as the image formation apparatus according to the first embodiment.

As described above, printer 1 as the image formation apparatus according to the first embodiment includes toner attachment sheet 17 arranged on the anterior surface of fixation unit 11. Hence, the scattered toner which is scattered inside printer 1 becomes attached to toner attachment sheet 17. Moreover, since toner attachment sheet 17 is replaceable, it is possible to replace toner attachment sheet 17 before the scattered toner attached to the sheet deposits and grows into a lump of the toner. In other words, printer 1 as the image formation apparatus according to the first embodiment can eliminate the scattered toner floating between fixation unit 11 and development unit 6. Particularly, the white toner has finer particles and contains a larger amount of iron components than the toner of other colors. Hence, the white toner is more likely to grow into a lump of the toner. Accordingly, printer 1 as the image formation apparatus according to the first embodiment is especially effective when the white toner is used therein.

In addition, since toner attachment sheet 17 is made replaceable (detachable), fixation unit 11 is prevented from being replaced earlier than its intrinsic life due to adverse effects caused by the toner adhesion. Thus, printer 1 also has an effect to lengthen the life of fixation unit 11.

Second Embodiment

Configuration of the Image Formation Apparatus According to a Second Embodiment A configuration of an image formation apparatus according to a second embodiment is described below. A difference between printer 1 as the image formation apparatus according to the first embodiment and printer 1A (not illustrated) as the image formation apparatus according to the second embodiment is that fixation unit 11 is changed into fixation unit 11A. In the following, descriptions are only given of portions of the configuration of printer 1A (not illustrated) according to the second embodiment that are changed from the first embodiment.

<Fixation Unit>

Figures 5A, 5B:
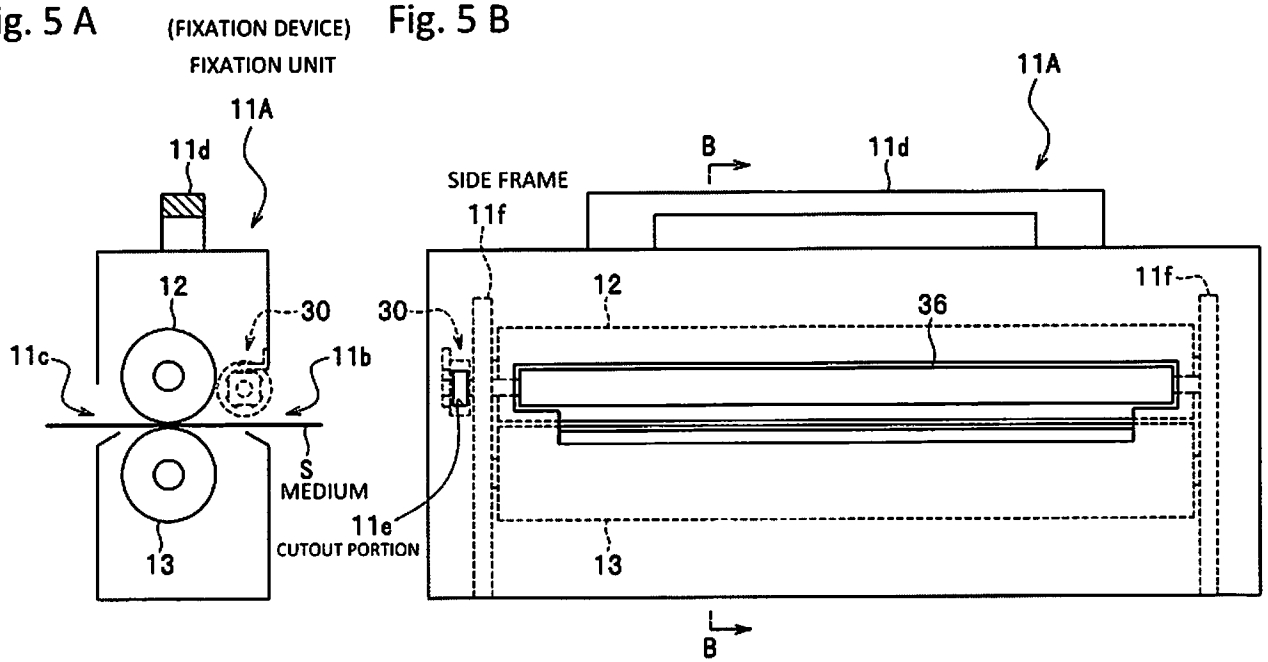
Figure 6:
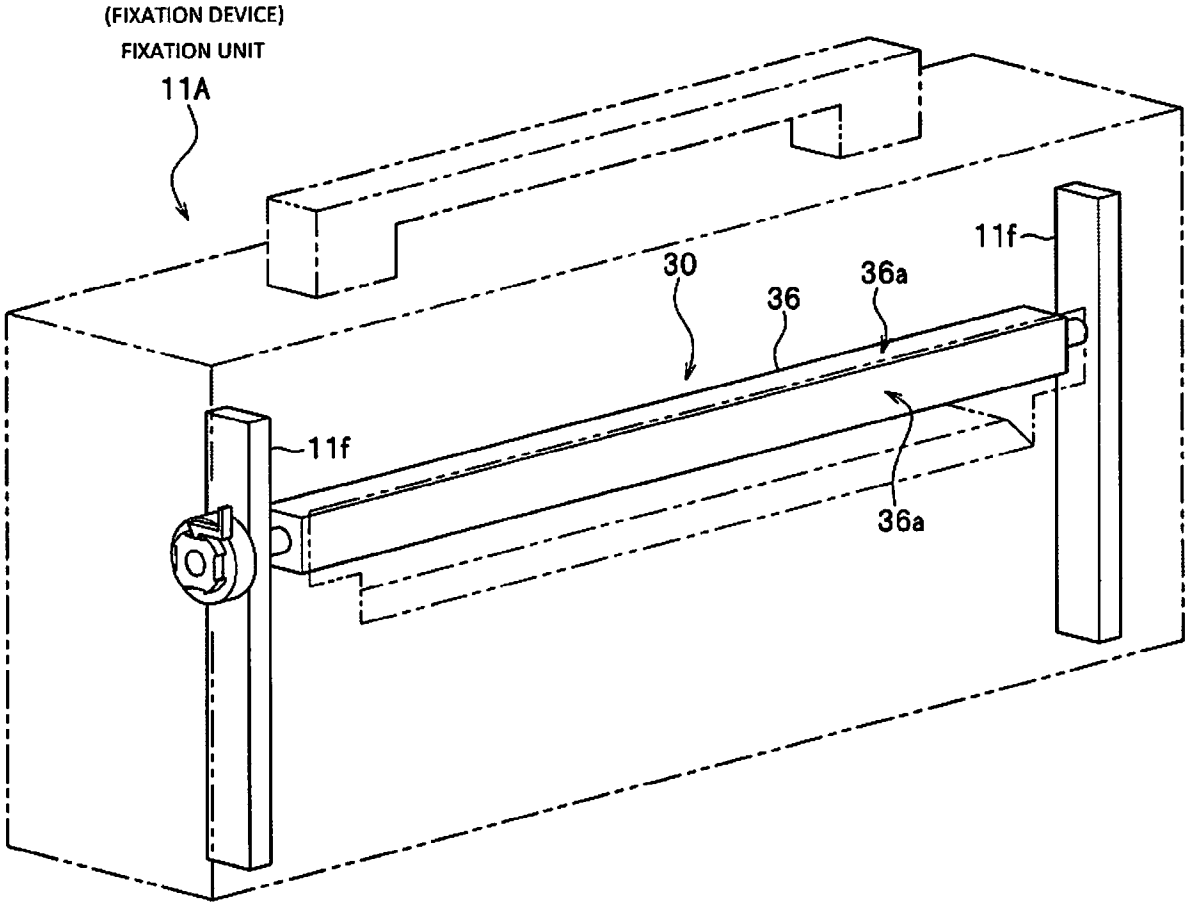
FIG. 6 is an external perspective view of a rotor according to the second embodiment.
Figure 7A:
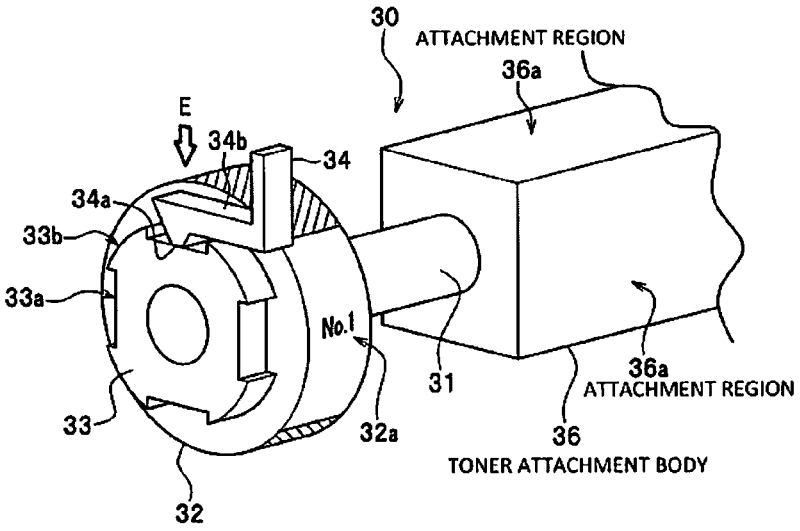
Figure 7B:
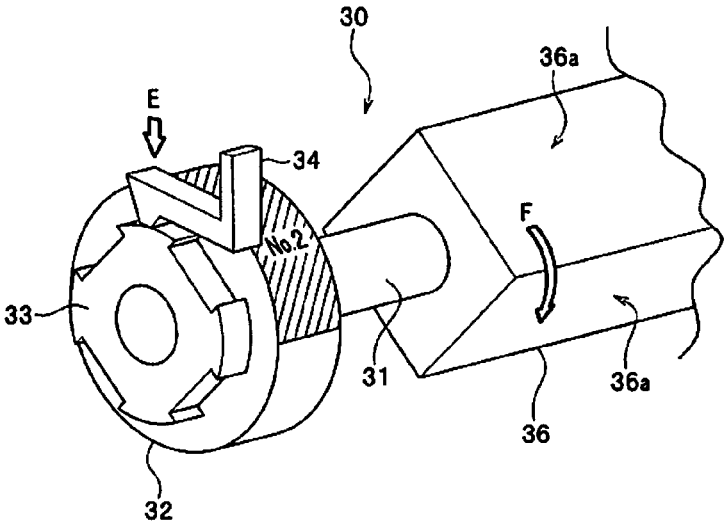
Figure 8:
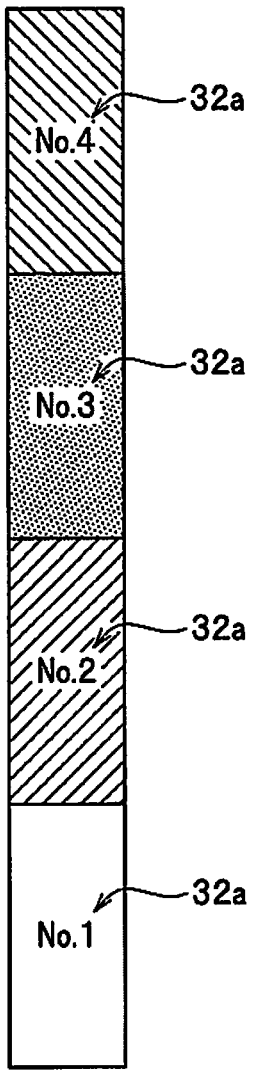
FIG. 8 is a view for explaining dial numbers according to the second embodiment.

A configuration of fixation unit 11A according to the second embodiment is described with reference to FIG. 5A to FIG. 8. FIG. 5A is a vertical sectional view of fixation unit 11A according to the second embodiment viewed in the direction of arrows B, B, and FIG. 5B is a front view of fixation unit 11A. FIG. 6 is an external perspective view of rotor 30 according to the second embodiment. FIG. 7A is a first enlarged perspective view of a substantial part of rotor 30 according to the second embodiment, and FIG. 7B is a second enlarged perspective view of a substantial part of rotor 30 according to the second embodiment. FIG. 8 is a view for explaining dial numbers 32*a* according to the second embodiment.

In place of toner attachment sheet 17, fixation unit 11A includes rotor 30 disposed inside housing 11*a* and above a position adjacent to an insertion slot. In addition, cutout portion 11*e* to make dial 32 on rotor 30 visible from outside of housing 11*a*, and side frames 11*f* configured to rotatably support ends (or portions near the ends) of shaft 31 of rotor 30, are formed in fixation unit 11A. The rest of the configuration of fixation unit 11A is similar to the configuration of fixation unit 11 according to the first embodiment and descriptions thereof are omitted. Now, rotor 30 is described below in detail.

(Rotor)

Rotor 30 includes shaft 31, dial 32, positioning gear 33, leaf spring 34, and toner attachment body 36. Toner attachment body 36 is a polygonal column having a polygonal cross section (which is a square cross section in FIG. 6), which is formed integrally with shaft 31 and is provided with attachment regions 36*a* with each attachment region being where scattered toner is attached. Dial 32 allows shaft 31 to penetrate therethrough, and is formed into a cylindrical shape. Dial numbers 32*a* serving as attachment region identification information to identify attachment regions 36*a* are described on a peripheral surface of dial 32. When four attachment regions 36*a* are formed on toner attachment body 36, dial numbers 32*a* are written as "No. 1", "No. 2", "No. 3", and "No. 4" as illustrated in FIG. 8. Dial numbers 32*a* are visible from the outside through cutout portion 11*e* of housing 11*a*. Accordingly, a user of printer 1A (not illustrated) can check as to which one of attachment regions 36*a* is located on a front surface of fixation unit 11A by seeing dial number 32*a* through cutout portion 11*e* of housing 11*a*.

Positioning gear 33 allows shaft 31 to penetrate therethrough, and is provided with rectangular recesses 33*a* (four in FIG. 6) and arc-shaped projections 33*b* (four in FIG. 6) in the same number as attachment regions 36*a*. Recesses 33*a* and projections 33*b* are formed on a peripheral surface of positioning gear 33 at equal angular intervals. Positioning gear 33 determines a rotational position (attachment region 36*a* to be located on a front surface of fixation unit 11A) by allowing protrusion 34*a* of leaf spring 34 to engage with one of recesses 33*a*. In other words, when dial 32 is rotated, positioning gear 33 is also rotated and is positioned every time projection 34*a* of leaf spring 34 engages with recess 33*a*. Leaf spring 34 includes projection 34*a* on a surface at a tip, which faces positioning gear 33, and presses projection 34*a* against positioning gear 33 by use of a biasing force (in a direction of arrow E in FIGS. 7A and 7B) generated by body portion 34*b* of leaf spring 34. This is the end of the explanation of printer 1A as the image formation apparatus according to the second embodiment.

Operations of the Image Formation Apparatus According to the Second Embodiment <Image Formation Operation>

The image formation operation of printer 1A (not illustrated) as the image formation apparatus according to the second embodiment is the same as that of printer 1 (see FIG. 1) as the image formation apparatus according to the first embodiment, and the description thereof is omitted.

<Operation Concerning Replacement of Attachment Region>

An operation concerning replacement of the attachment region of printer 1A as the image formation apparatus is described with reference to FIG. 5A to FIG. 7B. During the image formation operation described above, fixation unit 11A continuously radiates the heat since heating roller 12 includes the heat source (such as the halogen lamp). For this reason, upward air convection is constantly generated between fixation unit 11A and developer unit 6 inside printer 1A (not illustrated). Meanwhile, part of the toner forming the toner images on the surface of medium S is scattered from medium S due to vibrations generated when medium S is inserted into fixation unit 11A. Then, the scattered toner gets on the upward air convection and thereby moves up to rotor 30 arranged in the vicinity of insertion slot 11*b* of fixation unit 11A. Then, the toner is melted by the heat and fixed to attachment region 36*a* located on the front surface.

In the meantime, controller (replacement instruction unit) 90 counts the number of times image formation unit 5 forms the toner image, and outputs a replacement instruction for attachment region 36*a* (a rotation instruction for rotor 30) to operation panel 1*b* as the output unit or a display unit when the counted number exceeds the replacement time information stored in memory 80. The replacement instruction for attachment region 36*a* (the rotation instruction for rotor 30) is assumed as "please set the dial to No. 2", for example. Then, the user who sees the display of the replacement instruction for attachment region 36*a* (the rotation instruction for rotor 30) takes fixation unit 11A out of printer 1A by grasping grip 11*d* of fixation unit 11A and rotates dial 32 exposed from cutout portion 11*e* of fixation unit 11A with fingers and changes dial number 32*a* into the one ("No. 2" in this case) according to the replacement instruction for attachment region 36*a* (the rotation instruction for rotor 30). Thus, rotor 30 is rotated and new attachment region 36*a* corresponding to dial number 32*a* visible through cutout portion 11*e* is located on the front surface. This is the end of the explanation of the operations of printer 1A as the image formation apparatus according to the second embodiment.

As described above, printer 1A as the image formation apparatus according to the second embodiment includes rotor 30 arranged in the vicinity of insertion slot 11*b* of fixation unit 11A. Hence, the scattered toner which is scattered inside printer 1A becomes attached to one of attachment regions 36*a* of rotor 30. Moreover, since this attachment region 36*a* is replaceable with another attachment region 36*a* by rotating rotor 30, it is possible to replace attachment region 36*a* before the scattered toner attached to the region deposits and grows into a lump of the toner. In other words, printer 1A as the image formation apparatus according to the second embodiment can eliminate the scattered toner floating between fixation unit 11A and development unit 6, similar to printer 1 as the image formation apparatus according to the first embodiment.

In addition, since toner attachment body 36 is formed into a polygonal column having a polygonal cross section (which is a square cross section in FIG. 6), attachment region 36*a* can be replaced with another by rotating rotor 30 without replacing rotor 30 itself. Thus, the replacement operation is easier than the first embodiment.

[Modifications]

Although certain embodiments of the invention are described above, it is to be understood that the invention is not limited only to the embodiments and various modifications are possible without departing from the gist of the invention. Modifications of any of the embodiments are described below.

<Image Formation Apparatus>

While the first and second embodiments describe printers 1 and 1A as examples of the image formation apparatus, the invention is also applicable to other image formation apparatuses including an electrophotographic copier, a multifunction printer, a facsimile, and so forth.

<Fixture for Toner Attachment Sheet>

Figure 9:
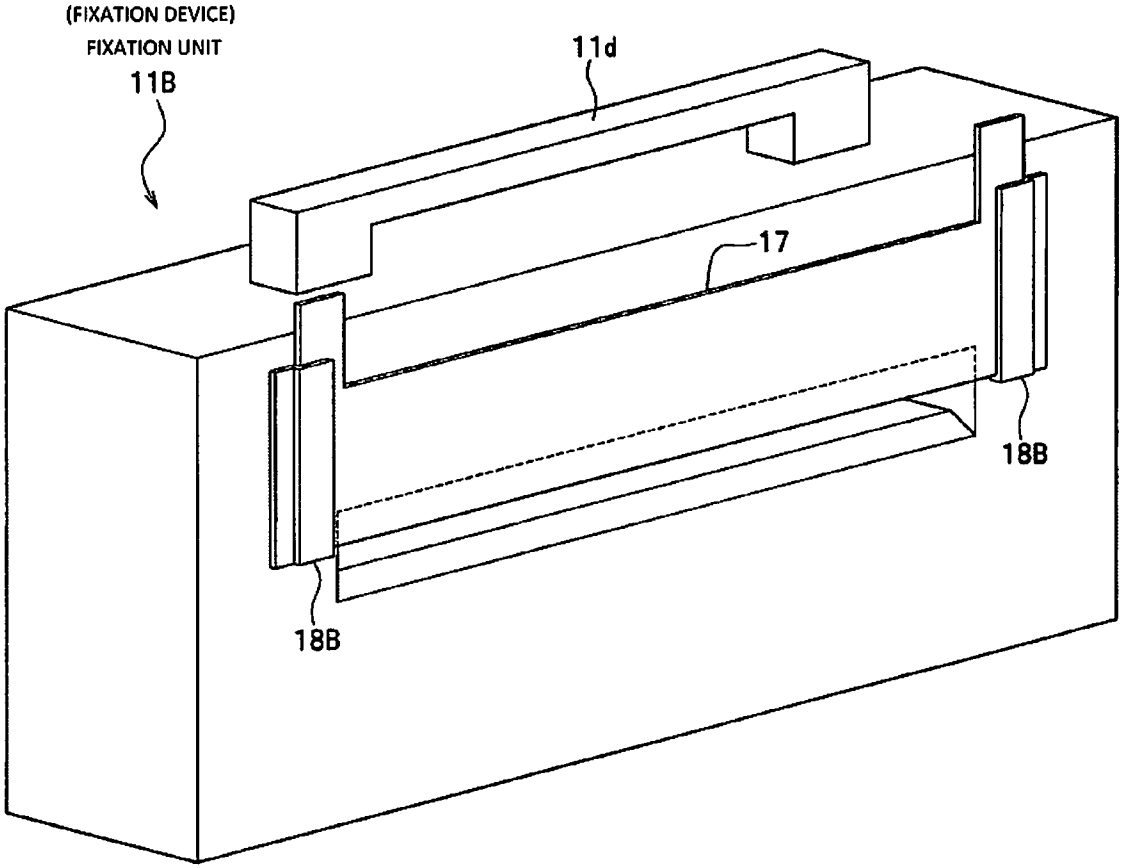
FIG. 9 is a view for explaining a modification of the fixation unit according to the first embodiment.

In the first embodiment, toner attachment sheet 17 adheres to the position above insertion slot 11*b* by using adhesive sheets 18 (three in FIG. 3). Instead, as illustrated in FIG. 9, it is also possible to form attachment tools 18B configured to attach toner attachment sheet 17 to a position above insertion slot 11*b* on the anterior surface of fixation unit 11. Here, forms of attachment tools 18B are not particularly limited and various forms are applicable.

<Output Unit>

While the first and second embodiments describe operation panel 1*b* provided with the liquid crystal display as an example of the output unit, a warning lamp or a loudspeaker can also be used as the output unit. Hence, the replacement instruction for toner attachment sheet 17 or the replacement instruction for attachment region 36*a* (the rotation instruction for rotor 30) may be issued by means of a blinking of the warning lamp, sound from the loudspeaker, and so forth.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image formation unit configured to form a developer image comprising a developer and to transfer the developer image to a medium;

a fixation unit including, a fixation member configured to thermally fix the developer image onto the medium being conveyed from the image formation unit through the fixation unit along a medium conveyance path, and a housing containing therein the fixation member; and a developer attachment member replaceably provided to the fixation unit and configured to cause the developer that is scattered in a neighborhood of the conveyance path to become attached thereto, wherein the developer attachment member is formed as a toner attachment sheet covering at least part of the surface of the housing, and wherein the toner attachment sheet is replaceable by detaching the toner attachment sheet from the housing.

2. The image formation apparatus according to claim 1, wherein the developer attachment member is detachably attached to a surface of the housing at a position opposed to the image formation unit.

3. The image formation apparatus according to claim 1, wherein the toner attachment sheet is made of a heat-resistant polyvinyl chloride.

4. The image formation apparatus according to claim 1, wherein the toner attachment sheet is detachably fixed to the housing by using a fixture.

5. The image formation apparatus according to claim 4, wherein the fixture is an adhesive sheet or an attachment tool.

6. The image formation apparatus according to claim 1, further comprising:

a replacement instruction unit configured to count a number of times the image formation unit forms the developer image, and to cause an output unit to output a replacement instruction for the developer attachment member when the counted number exceeds a predetermined value.

7. The image formation apparatus according to claim 4, wherein the toner attachment sheet is provided above the conveyance path.

8. The image formation apparatus according to claim 4, wherein the toner attachment sheet is provided above the conveyance path between the image formation unit and the fixation unit.

9. An image formation apparatus comprising:

an image formation unit configured to form a developer image comprising a developer and to transfer the developer image to a medium;

a fixation unit including, a fixation member configured to thermally fix the developer image onto the medium being conveyed from the image formation unit through the fixation unit along a medium conveyance path, and a housing containing therein the fixation member; and a developer attachment member including attachment regions each of which is configured to cause developer that is scattered in a neighborhood of the medium conveyance path to become attached thereto, wherein the developer attachment member is movable relative to the housing so that the attachment region located in a predetermined position is replaceable with another attachment region, wherein the developer attachment member is a rotor of a polygonal cross section with side surfaces, the rotor being provided to be rotatable relative to the housing, and wherein the side surfaces are the attachment regions.

10. The image formation apparatus according to claim 9, wherein the housing includes an opening on a surface of the housing opposed to the image formation unit, the rotor as the developer attachment member is disposed inside the housing, and at least one of the attachment regions is exposed from the opening to the outside of the housing depending on a rotational position of the rotor.

11. The image formation apparatus according to claim 10, wherein the fixation member includes a heating roller, and the rotor as the developer attachment member is arranged adjacent to the heating roller inside the housing.

12. The image formation apparatus according to claim 9, wherein the fixation member includes a heating roller, and a downstream side of the developer attachment member in the medium conveyance direction faces the heating roller.

13. The image formation apparatus according to claim 9, wherein the developer attachment member is provided above the conveyance path.

14. The image formation apparatus according to claim 9, wherein the developer attachment member is provided above the conveyance path between the image formation unit and the fixation unit.

15. The image formation apparatus according to claim 9, wherein the developer attachment member is provided above the conveyance path downstream of a transfer unit of the image formation unit in the medium conveyance direction.

16. The image formation apparatus according to claim 9, further comprising:

a replacement instruction unit configured to count a number of times the image formation unit forms the developer image, and to cause an output unit to output a replacement instruction for the attachment region when the counted number exceeds a predetermined value.

17. A fixation device comprising:

a fixation member configured to thermally fix a developer image onto a medium, the developer image being transferred onto the medium by a transfer unit;

a housing containing therein the fixation member; and a developer attachment member configured to attach thereto the developer scattered in a neighborhood of a conveyance path for the medium, wherein the developer attachment member is replaceably provided to and covers at least part of a surface of the housing, wherein the housing is formed with an insertion opening through which the medium is conveyed into the housing, and wherein a part of the developer attachment member covers an upper portion of the insertion opening.

18. The fixation device according to claim 17, wherein the developer attachment member includes at least one extension portion extending upward with respect to the housing so as to protrude above the housing when installed in an image formation apparatus.

19. The fixation device according to claim 17, wherein the developer attachment member is formed as a toner attachment sheet covering at least part of the surface of the housing, and wherein the toner attachment sheet is made of a heat-resistant polyvinyl chloride.

20. The fixation device according to claim 17, wherein the developer attachment member is formed as a toner attachment sheet covering at least part of the surface of the housing, and wherein the toner attachment sheet is detachably fixed to the housing by using a fixture.

21. The fixation device according to claim 20, wherein the fixture is an adhesive sheet or an attachment tool.

22. An image formation apparatus comprising:

an image formation unit configured to form a developer image comprising a developer and having a transfer unit to transfer the developer image to a medium; and the fixation device according to claim 17.

* * * * *